US011517055B1

(12) United States Patent
Cristiano

(10) Patent No.: US 11,517,055 B1
(45) Date of Patent: Dec. 6, 2022

(54) UNDERGARMENTS WITH MAGNETIC CLASPS

(71) Applicant: SNAPPY WEAR LLC, Costa Mesa, CA (US)

(72) Inventor: Aurora Cristiano, Costa Mesa, CA (US)

(73) Assignee: SNAPPY WEAR LLC, Costa Mesa, CA (US)

( * ) Notice: Subject to any disclaimer, the term of this patent is extended or adjusted under 35 U.S.C. 154(b) by 0 days.

(21) Appl. No.: 17/549,759

(22) Filed: Dec. 13, 2021

(51) Int. Cl.
*A41B 9/00* (2006.01)
*A41F 1/00* (2006.01)

(52) U.S. Cl.
CPC ..... *A41B 9/002* (2013.01); *A41F 1/002* (2013.01)

(58) Field of Classification Search
CPC ..... A41F 1/002; A41B 9/007; A41B 9/008; A41B 9/002
See application file for complete search history.

(56) References Cited

U.S. PATENT DOCUMENTS 2,326,380 A 8/1943 Miller
2,419,867 A * 4/1947 Woodman ..... A41B 9/002 2/403
2,431,571 A * 11/1947 Lehr ..... A41B 9/02 2/238
2,621,335 A 12/1952 Brown et al.
2,743,456 A 5/1956 Yarnell
3,029,814 A * 4/1962 Kravitz ..... A61F 5/03 2/403
3,639,330 A * 2/1972 Fitzhugh et al. .... C09D 129/14 524/509
4,122,552 A 10/1978 Tedford
4,229,835 A 10/1980 Shaw
4,698,855 A 10/1987 Hicks
4,835,795 A * 6/1989 Lonon ..... A41B 9/08 2/408
4,905,323 A * 3/1990 Lampman ..... A41B 9/008 2/46
5,103,501 A 4/1992 Meisels
5,347,657 A * 9/1994 Unsell ..... A41D 7/005 2/400
5,535,452 A * 7/1996 Rozenblat ..... A41D 13/1254 2/403
5,551,093 A 9/1996 Stricker
5,561,858 A * 10/1996 Poirier ..... A41D 7/00 2/408
5,991,920 A * 11/1999 Holland ..... A41D 7/00 2/400

(Continued)

FOREIGN PATENT DOCUMENTS

WO 2020/089940 A1 5/2020

OTHER PUBLICATIONS

Cool Things—"Lingerie Dement Banishes Hooks and Clasps in favor of Magnets" https://www.coolthings.com/lingerie-dement/ Oct. 25, 2010, 16 pages.

(Continued)

*Primary Examiner* — Richale L Quinn
(74) *Attorney, Agent, or Firm* — Steinfl + Bruno LLP

(57) ABSTRACT

A garment with narrow back coverage having a clasp system that has magnets attaching to a metal plate magnetically. The magnets can attach to the plate in several points, providing an adjustability to the waist-size of the garment.

18 Claims, 9 Drawing Sheets

(56) References Cited

U.S. PATENT DOCUMENTS 6,027,484 A * 2/2000 Romare ..... A61F 13/58 604/394
6,035,439 A * 3/2000 Chin ..... A41B 9/08 2/408
6,247,184 B1 * 6/2001 Watts ..... A41B 9/001 2/400
6,560,786 B2 * 5/2003 Lipton ..... A41B 9/008 2/400
6,643,845 B2 * 11/2003 O'Dea ..... A41D 19/01594 224/183
D648,098 S * 11/2011 Mitchell ..... D2/712
8,108,947 B2 * 2/2012 Beauvais ..... A41B 9/08 2/80
8,181,273 B2 * 5/2012 Kane ..... A61F 13/491 604/385.28
8,387,412 B2 * 3/2013 O'Byrne ..... A44C 5/0007 63/40
8,430,858 B2 * 4/2013 Back ..... A61F 13/565 604/394
8,769,717 B2 * 7/2014 Holland ..... A41D 7/005 2/67
8,926,579 B2 * 1/2015 Wang ..... A61F 13/68 604/385.15
D793,659 S * 8/2017 Wexler ..... D2/712
9,750,287 B2 9/2017 Cohen et al.
10,609,969 B2 * 4/2020 Castellano ..... A41D 7/00
2002/0062511 A1 * 5/2002 Lee ..... A41D 13/1263 2/78.2
2002/0151858 A1 * 10/2002 Karami ..... A61F 13/49019 604/389
2005/0143709 A1 * 6/2005 Lindstrom ..... A61F 13/5622 604/391
2006/0264885 A1 * 11/2006 Carstens ..... A61F 13/66 604/402
2008/0091163 A1 * 4/2008 Fujioka ..... A61F 13/4942 2/400
2009/0118574 A1 * 5/2009 Stephenson ..... A41B 9/04 600/38
2009/0320184 A1 * 12/2009 Schaefer ..... A41B 9/02 2/400
2010/0005570 A1 * 1/2010 Rachman ..... A61F 13/505 604/396
2010/0163758 A1 * 7/2010 Kirschenbaum ..... G21F 3/02 250/516.1
2010/0312207 A1 * 12/2010 Rezai ..... A61F 13/51121 604/365
2011/0083254 A1 * 4/2011 Trutna ..... A41F 3/02 2/326
2012/0046634 A1 * 2/2012 Shields ..... A61F 13/622 604/391
2012/0253304 A1 * 10/2012 Scott ..... A61F 13/15699 493/379
2012/0324632 A1 * 12/2012 Hurvitz ..... A41B 9/001 2/400
2013/0239300 A1 * 9/2013 Denning ..... A41B 9/001 2/400
2013/0283502 A1 10/2013 Denning
2014/0130228 A1 * 5/2014 Horton ..... A41D 3/02 2/270
2014/0130233 A1 * 5/2014 Horton ..... A41F 1/002 2/69
2014/0143935 A1 * 5/2014 Rose ..... A41D 27/00 2/234
2014/0215692 A1 * 8/2014 Mohammadian ..... A41B 9/008 2/406
2014/0259266 A1 * 9/2014 Federlin ..... A41F 1/002 2/69
2014/0366242 A1 * 12/2014 Pulsifer ..... A41B 3/04 2/139
2016/0113329 A1 * 4/2016 Baker ..... A41B 9/008 2/400
2016/0143373 A1 * 5/2016 Castellano ..... A41D 11/00 2/67
2017/0367413 A1 * 12/2017 Vera ..... A41B 9/007
2018/0084842 A1 * 3/2018 Pham Johnson ..... A41D 1/21
2018/0368482 A1 * 12/2018 Chea ..... A41B 9/04
2020/0029629 A1 * 1/2020 Jarvis ..... A41D 27/20
2021/0076751 A1 * 3/2021 Dubose ..... A44B 18/0003
2021/0186121 A1 6/2021 Denning

OTHER PUBLICATIONS

HuffPost Life—"Magnetic Lingerie: Would You Wear It?" https://www.huffpost.com/entry/magnetic-lingerie-would-y_n_780684 Nov. 8, 2010, 9 pages.
Metro News—"Insane lingerie ditches bra hooks for magnets" https://metro.co.uk/2010/11/10/insane-lingerie-ditches-bra-hooks-for-magnets-576596/Nov. 10, 2010, 18 pages.
The Quirky Globe—"Bra company uses magnets . . . no hooks." http://thequirkyglobe.blogspot.com/2010/11/bra-company-uses-magnets-no-hooks.html Nov. 10, 2010, 4 pages.
Yandy—"Men's Cohen Magnetic Thong" https://www.yandy.com/products/mens-cohen-magnetic-thong Aug. 23, 2021, 3 pages.

* cited by examiner

UNDERGARMENTS WITH MAGNETIC CLASPS

SUMMARY

Undergarments (including swimwear) having a small back coverage are provided a magnetic clasp mechanism to allow easy donning and removal as well as an adjustable waistband sizing. Magnets at each end of the side wings attach magnetically to one or more plates located at the tail end of the back coverage. The sizing of the plate compared to the magnets allow an adjustment of the tightness of the waistband.

Embodiments include an aspect of an undergarment configured to be worn by a user, comprising: a front coverage and a back coverage, the back coverage having a tail end and having an area less than the front coverage; a band extending from the front coverage in a first direction and a second direction along a long axis of the band, the band having a first band end in the first direction and a second band end in the second direction; a first magnet at the first band end and a second magnet at the second band end; and a single metal plate at the tail end, the single metal plate having a single metal plate lateral extension along a substantial portion of a width of the top portion of the tail end and being configured to magnetically interact with both the first magnet and the second magnet.

Embodiments include an aspect of an undergarment configured to be worn by a user, comprising: a front coverage and a back coverage, the back coverage having a tail end and having an area less than the front coverage; a band extending from the front coverage in a first direction and a second direction along a long axis of the band, the band having a first band end in the first direction and a second band end in the second direction; a first magnet at the first band end and a second magnet at the second band end; a first plate at the tail end, the first plate having a first plate lateral extension along a substantial portion of a width of the tail end and being configured to magnetically interact with both the first magnet and the second magnet; and a second plate that also magnetically attaches to the first magnet and the second magnet when worn.

Embodiments include aspects where the undergarment is swimwear.

Further embodiments can be understood from the detailed description, drawings, and claims.

The embodiments shown in the figures are exemplary and not fully limiting to the scope of the invention.

DETAILED DESCRIPTION

As used herein, the term "undergarment" refers to any garment intended to be worn beneath clothing or any garment intended as "nightwear". Examples include panties, underwear, negligee, chemise, bodysuit, or the like. The term also extends to swimwear (e.g., a garment with waterproof fabric) where the front coverage has a larger area than the back coverage.

Figure 1:
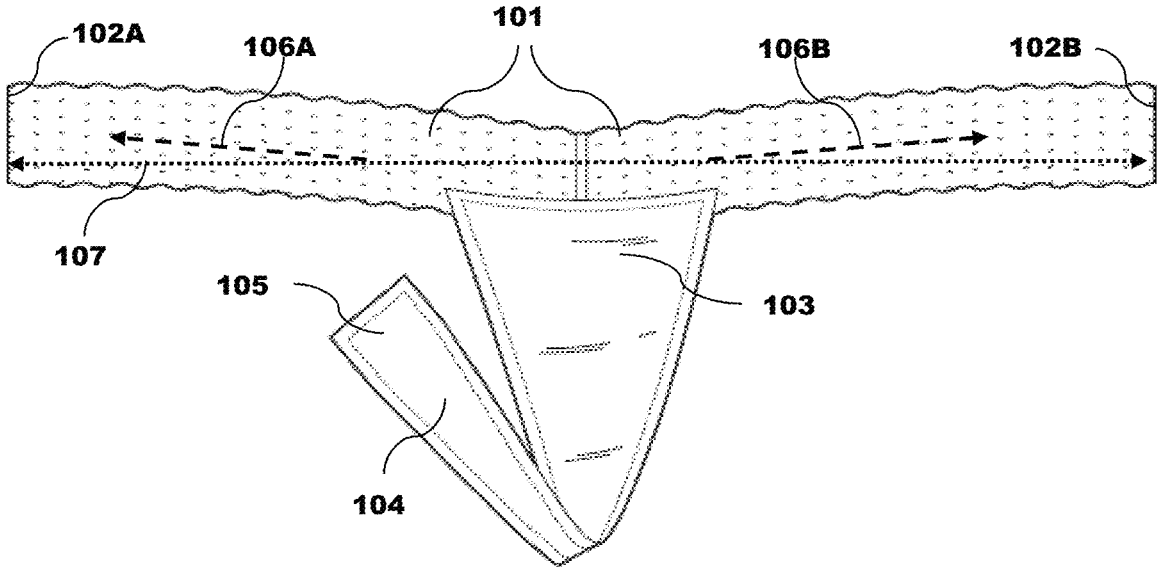
FIG. 1 shows an example of an undergarment.

FIG. 1 shows an example of an undergarment without the magnetic clasp. The portions as used herein are described as the side wings (or "band") (101) extending in a first (106A) and a second (106B) direction opposing each other along a long axis (107) of the band with two band ends (102A and 102B) at the terminations in each direction, the front coverage (or "front") (103), the back coverage (104) with a tail end (105), the back coverage having a smaller area than the front coverage. In some embodiments, the band can range in width from 38 mm to 50 mm. In some embodiments, the back coverage can, at its narrowest point, range from 25 mm to 75 mm. In some embodiments, the tail end of the back coverage can range from being equal in width to the rest of the back coverage to being wider than the rest of the back coverage, up to 2.5 inches in width. The back coverage is narrower than the front coverage (e.g., thong). The band can be any fabric, including lace.

Figure 2:
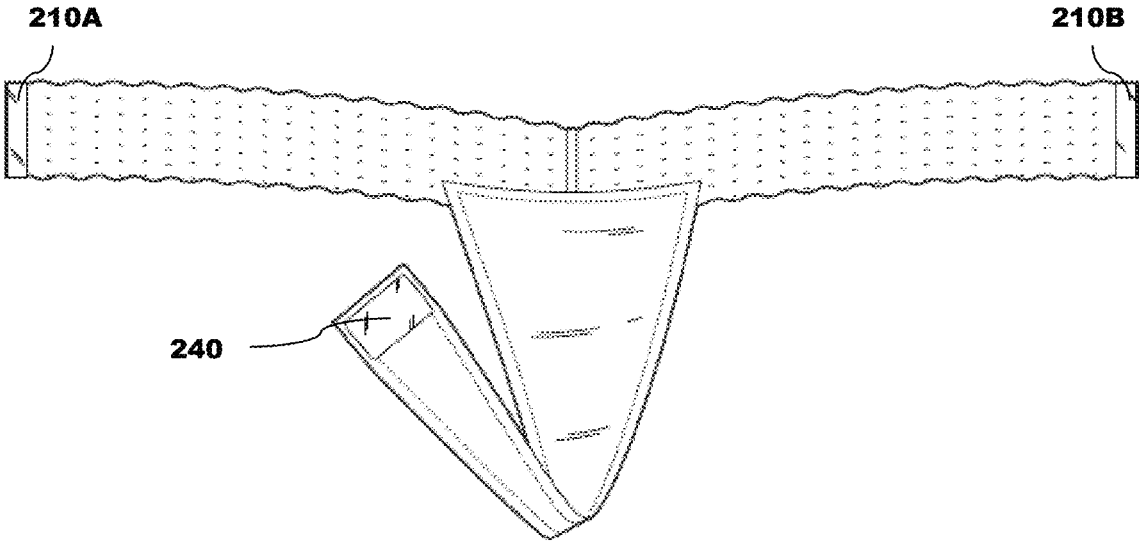
FIG. 2 shows an example of an undergarment with magnetic clasps and corresponding plate.

FIG. 2 shows an example of the magnetic clasp on an undergarment. The band ends each include a magnet (210A and 210B) with a metal plate (240) situated at the tail end. In this embodiment, the metal plate covers a substantial portion (at least 75%) of the width of the tail end. In other embodiments, the metal plate covers less than 75% of the width of the tail end.

In some embodiments, the metal plate is a ferromagnetic material, such as stainless steel. In some embodiments, the metal plate is a non-magnetic ferromagnetic plate. In some embodiments, the plate is a magnetized or magnetic material.

The magnets can be magnetic ferromagnetic material or a rare earth magnet, such as a neodymium magnet, or any permanent magnet.

The plate and/or magnets can be encased in order to protect the plate from corrosion and/or to make attachment to the undergarment easier. Encasings can include polyvinyl chloride (PVC) plastic, thermoplastic polyurethane (TPU), fabric (silk, nylon, cotton, etc.), or similar materials. The plate and/or magnets can be coated, such as with metal plating (nickel, silver, gold, etc.) or with a plastic coating or with an epoxy coating (e.g., black epoxy).

The plate and/or magnets can be attached to the tail end by adhesion, rivets, or sewing (sewn through holes in the plate and/or magnets or their encasing, or sewn into a pocket formed in the tail end, or included with a gusset for the tail end).

Cotton 'pockets' can be created by folding the cotton around the magnet/plate and sewing to the lace of the band. In some embodiments, an encased magnet is sewn to the band. When using lace, a piece of cotton can be placed between the encasing material and lace. the front of the magnet can then be covered, e.g., for cosmetic reasons, with fabric or lace.

The plate and/or magnets can be any shape. The example shown in FIG. 2 show rectangular elements, but they could also be, for example, circular, triangular, diamond, oval, heart or semi-heart shaped, or any other shape or design. The dimensions of the plate can vary based on design, so long as the magnets are able to attach both to the plate.

In some embodiments, the side-to-side width (along the long axis of the band) of each magnet is less than the width of the plate, thereby allowing multiple locations on the plate for the magnets to be attached magnetically.

Figure 3:
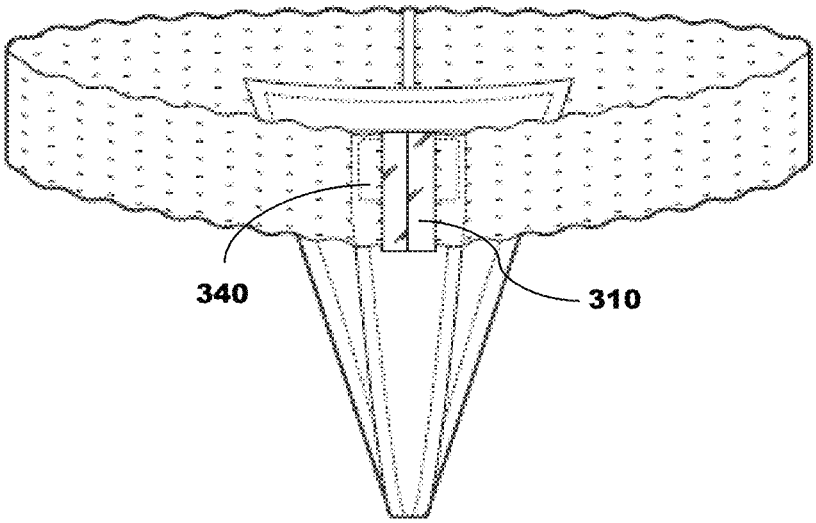
FIG. 3 shows an example of an undergarment with magnetic clasps in a closed configuration.

FIG. 3 shows an example of the magnetic clasp being closed. As shown, each magnet (310) attaches magnetically to the plate (340). In this (and some others) example, the plate is shown as being wider than it is vertically, but embodiments can include a plate that is taller vertically than it is wide, or equally tall (square). The magnets and/or plates can be enclosed/coated with a protective material (e.g., plastic).

Figure 4A:
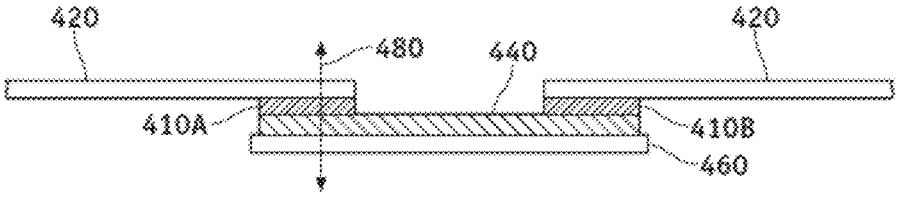
FIGS. 4A to 4C show an example of the magnetic clasps in cross-section.
Figure 4B:
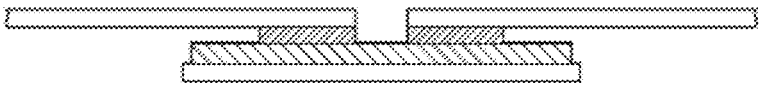
Figure 4C:
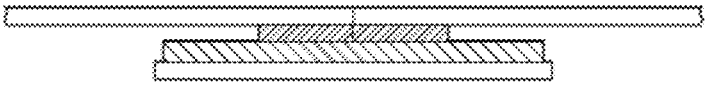

FIGS. 4A-4C show an example of the magnetic clasp having multiple attachment locations, presenting the user with user-selectable removable positions for the clasp. The figures show the clasp in cross-section, with the band (420) having magnets (410A and 410B) attached to their ends, and a plate (440) attached to the tail (460).

In FIG. 4A, the magnets (410A and 410B) are maximally separated from each other while still being well attached to the plate (440). The strongest magnetic flux (480) is perpendicular to the largest faces of the magnets and plate, providing the strongest attachment of a magnet to the plate. In an alternative embodiment, the magnetic flux can be transverse to the face, providing a stronger "pull" between the two magnets (given a proper N-S orientation) at the cost of a weaker attachment to the plate. If the plate is also magnetic, then the N-S orientations of all elements should be set to provide attraction between each magnet to the plate.

In FIG. 4B, the magnets are shown to be in a closer configuration, which results in a tighter band. In FIG. 4C, the magnets are shown to be in the closest configuration, which corresponds to the smallest waistband size for the undergarment adjustment (from the clasps).

Figure 5:
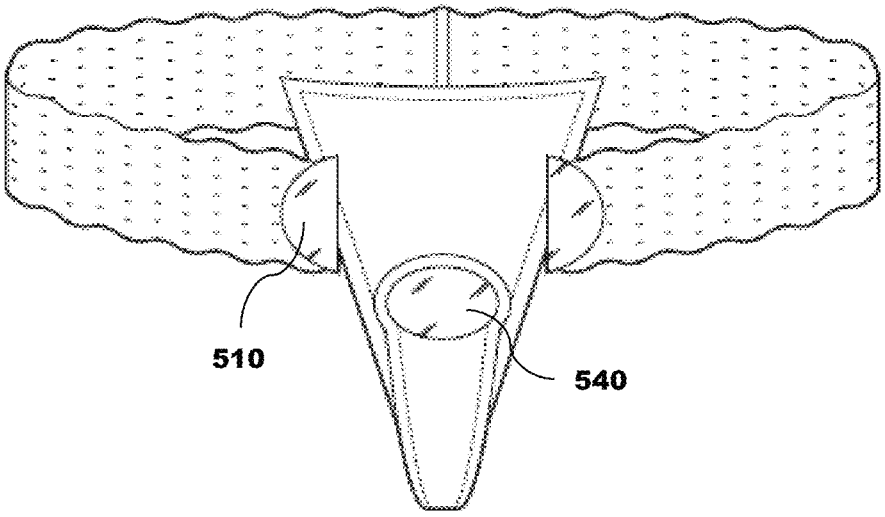
FIG. 5 shows an example of magnetic clasps with an oval or circular plate.

FIG. 5 shows an example of an oval or circular magnetic clasping mechanism. The magnets (510) can be in a half-circle or half-oval shape, such that they connect to form a circle or oval when at the smallest waist size. The plate (540) can be a circle or oval to match the general shape of the combined magnets (510). In some embodiments the band-axis diameter of the plate (540) is greater than that of the combined magnets (510) such that multiple magnetic attachment points are available, just as in FIGS. 4A-4C.

Figure 6:
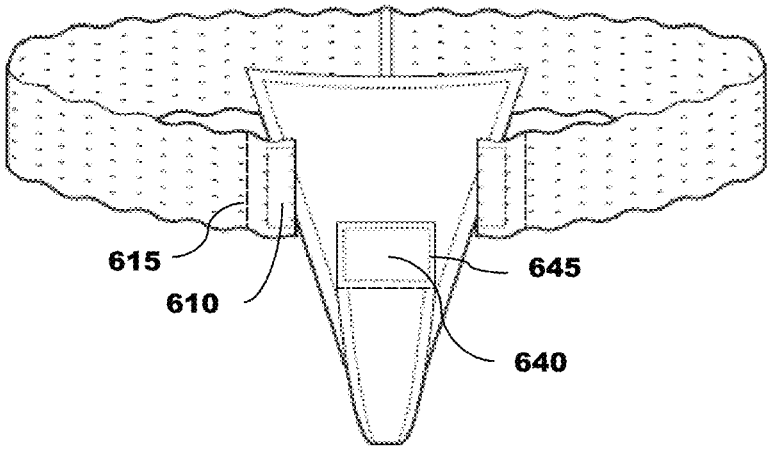
FIG. 6 shows an example of magnetic clasps with enclosed elements.

FIG. 6 shows example embedded elements for the clasp system. Here the magnets (610) are sewn in pockets (615) at the ends of the band, and the plate (640) is sewn in a pocket (645) at the end of the back coverage.

Figure 7:
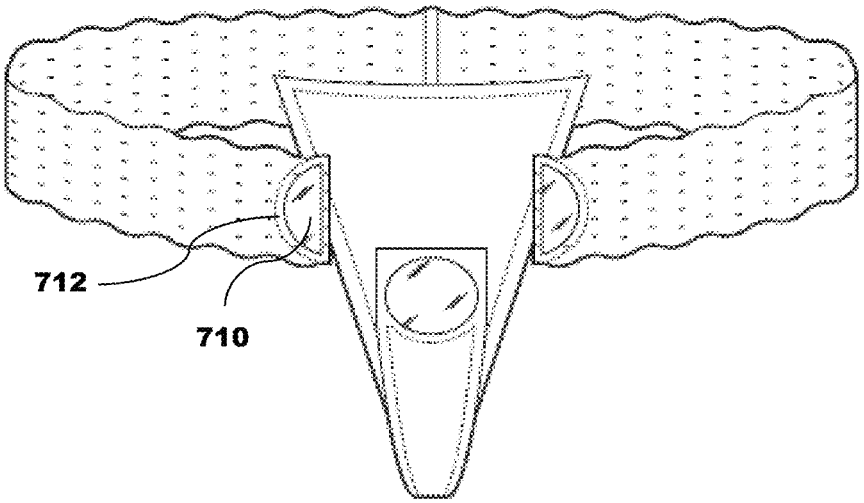
FIG. 7 shows an example of magnetic clasps with an oval or circular plate and some reinforced elements.

FIG. 7 shows an example of reinforced elements for the clasp system. In this example, the magnets (710) have a fabric reinforcement (712) behind the magnets.

Figure 8:
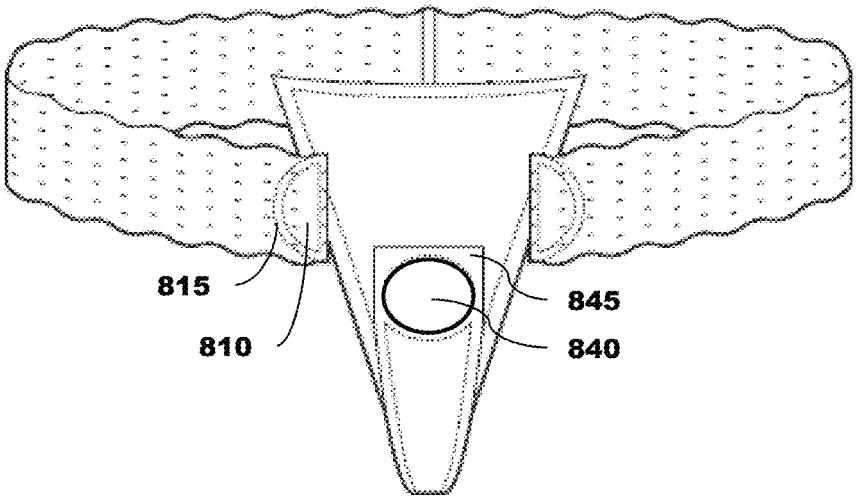
FIG. 8 shows an example of magnetic clasps with an oval or circular plate with plate interior to the garment.

FIG. 8 shows the example of the magnets (810) being in an enclosure (815) and a plate (840) being interior on the tail end (845). While this embodiment has elements enclosed in the garment and the plate facing outward (exterior to garment), the magnets and/or plates can also be facing otherwise (e.g. with the plate inward and the magnets outward or inward) or as being exposed to both the interior and exterior of the garment at the same time (e.g. as a piece attached to an end of the fabric) or neither (e.g. embedded in the fabric). In some embodiments, the plates are also embedded in the cloth such that they are neither interior nor exterior on the garment.

Figure 9:
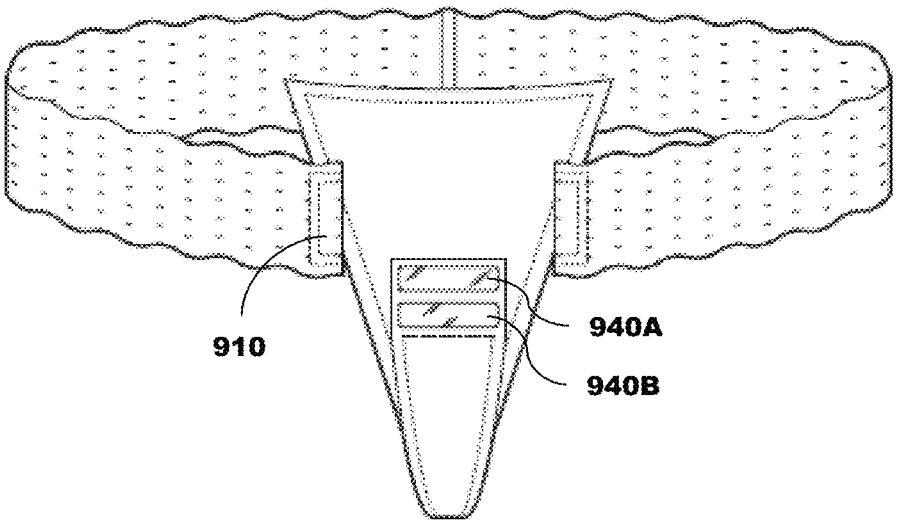
FIG. 9 shows an example of magnetic clasps with multiple plates.

In some embodiments, the tail end has multiple plates. FIG. 9 shows an example where the tail has a top plate (940A) and a bottom plate (940B) below and parallel to the top plate. In some embodiments, there are more than two plates. In some embodiments, the plates are arranged as parallel vertical columns (e.g., left and right bars).

Figure 10:
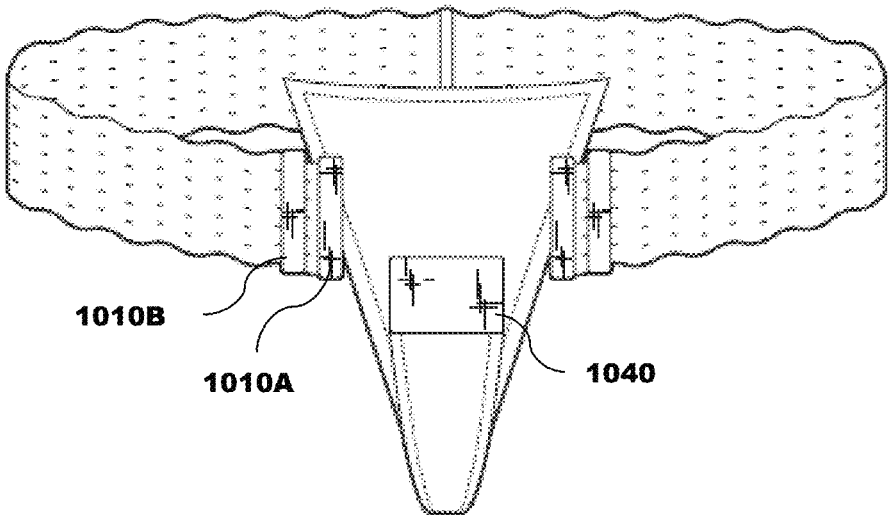
FIG. 10 shows an example of magnetic clasps with two clasps per side.
Figure 11:
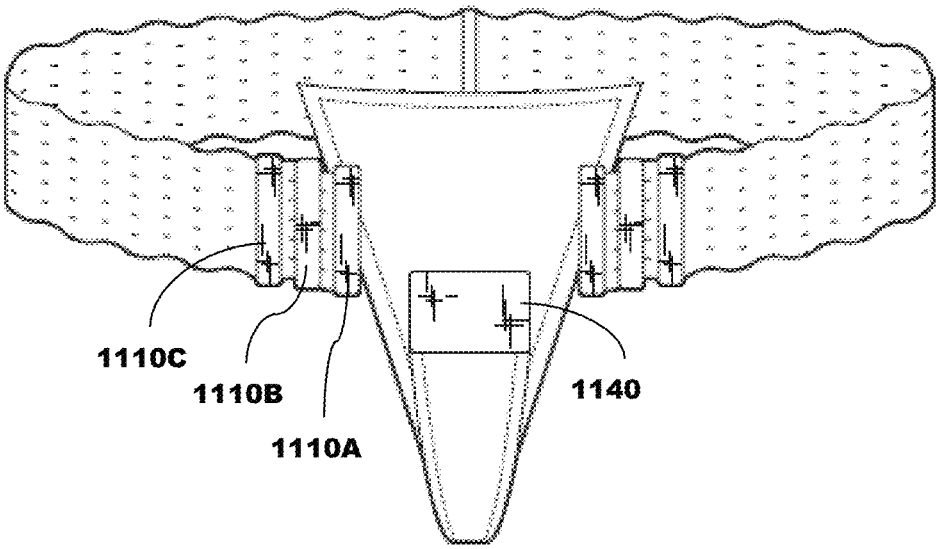
FIG. 11 shows an example of magnetic clasps with multiple clasps per side.

In some embodiments, there are more than one magnet per band end. FIG. 10 shows an example of a first magnet (1010A) and a second magnet (1010B) at each end to attach to the plate (1040). The band can be attached just with the first magnets (1010A) but will be more secure if both magnets are attached. FIG. 11 show an example with three magnets (1110A, 11108, and 1110C) per band end to attach to the plate (1140). The attachment can be made with one (1110A), two (1110A and 1110B), or three (1110A, 1110B, and 1110C) magnets, with increasing attachment strength.

In some embodiments, there are both multiple magnets per band end and multiple plates on the tail end.

In some embodiments, the elements in the band are not magnetic, but are ferromagnetic, and the plate is magnetic.

Figure 12:
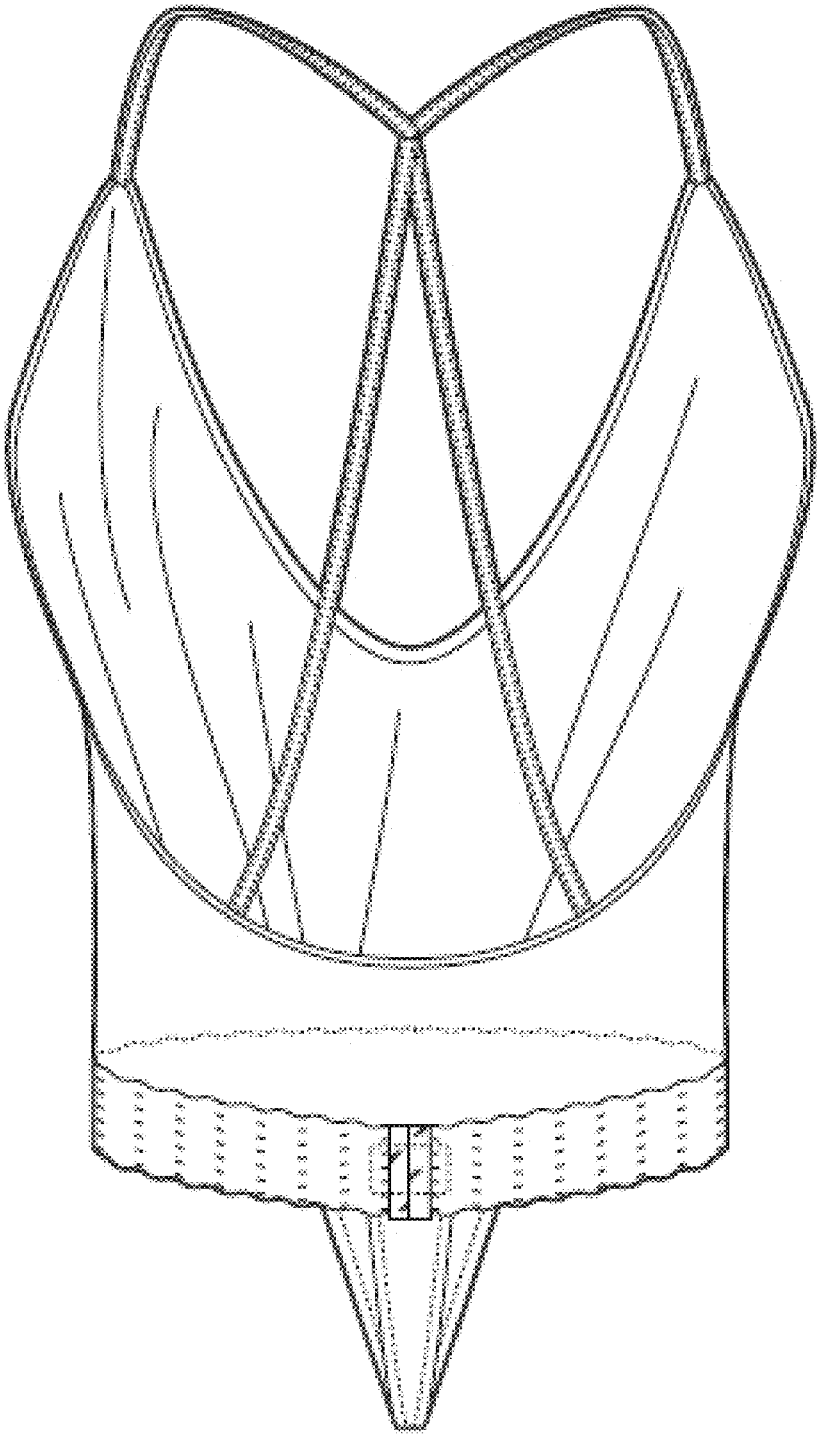
FIG. 12 shows an example of magnetic clasps on a garment with a backless top.
Figure 14:
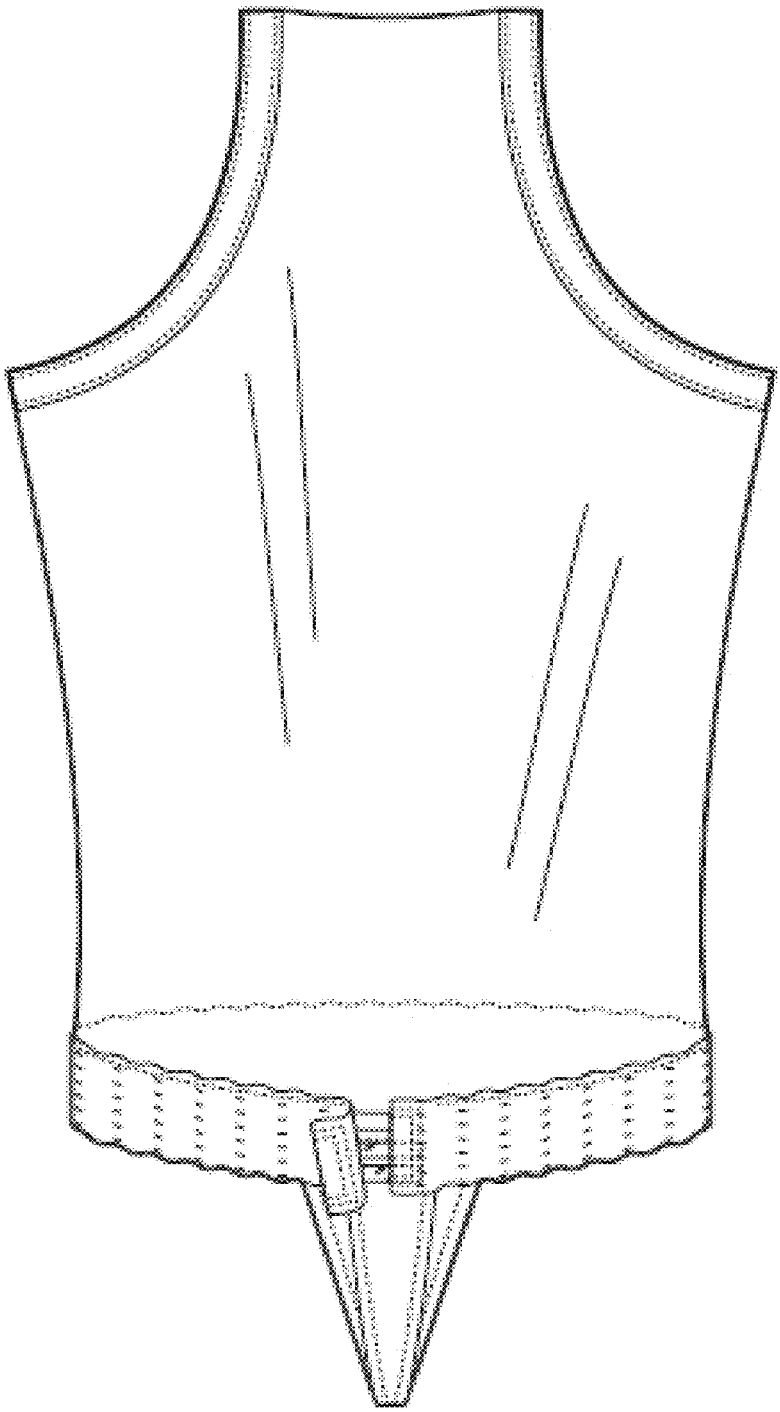
FIG. 14 shows an example magnetic clasps on a garment with a top.

In some embodiments, the clasp can be used for undergarments that include a top portion that at least partially covers the torso of the wearer. FIG. 12 shows an example of the clasp on a garment with a backless top. FIG. 14 shows an example of a two-plate clasp on a garment with a top with a full back.

Figure 13:
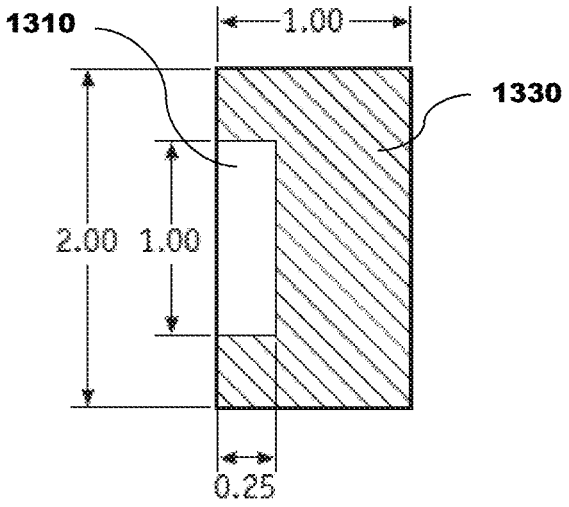
FIG. 13 shows an example top-view of an embedded magnet.

In some embodiments, the magnet can be incorporated in a supporting enclosure. FIG. 13 shows an example of a magnet (1310) set in a PVC enclosure (1330), shown in top-view (viewing normal to the largest face). The example has dimensions in inches, but any scale or relative sizes can be used. Some example dimensions are: 25.4 mm×6.35 mm×1.587 mm magnets, 25.4 mm×12.7 mm×1 mm plate, and 25.4 mm×25.4 mm×1 mm plate.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The following are claimed:

1. An undergarment configured to be worn by a user, comprising:

a front coverage and a back coverage, the back coverage having a tail end and having an area less than the front coverage;

a band extending from the front coverage in a first direction and a second direction along a long axis of the band, the band having a first band end in the first direction and a second band end in the second direction;

a first magnet flush with an extreme distal end of and covering an entire vertical dimension of the first band end and a second magnet flush with an extreme distal end of and covering an entire vertical dimension of the second band end; and a single metal plate at the tail end, the single metal plate having a single metal plate lateral dimension along a majority of the top portion of the tail end and being configured to magnetically attach to both the first magnet and the second magnet, the first magnet and second magnet covering at least an entirety of a vertical dimension of the single metal plate when magnetically attaching.

2. The undergarment of claim 1, wherein each magnet has a width along the long axis of the band smaller than half the width of the single metal plate along the long axis of the band when worn, thus providing a plurality of user-selectable removable attachment positions of the first magnet and the second magnet on the single metal plate.

3. The undergarment of claim 1, wherein the single metal is ferromagnetic.

4. An undergarment configured to be worn by a user, comprising:

a front coverage and a back coverage, the back coverage having a tail end and having an area less than the front coverage;

a band extending from the front coverage in a first direction and a second direction along a long axis of the band, the band having a first band end in the first direction and a second band end in the second direction;

a first magnet flush with an extreme distal end of and covering an entire vertical dimension of the first band end and a second magnet flush with an extreme distal end of and covering an entire vertical dimension of the second band end;

a first plate at the tail end, the first plate having a first plate lateral dimension along a majority of a width of the tail end and being configured to magnetically attach to both the first magnet and the second magnet, the first magnet and the second magnet covering more than an entirety of a vertical dimension of the first plate when magnetically attaching to the first plate; and a second plate that also magnetically attaches to the first magnet and the second magnet when worn, the first magnet and the second magnet covering more than an entirety of a vertical dimension of the second plate when magnetically attaching to the second plate.

5. The undergarment of claim 4, wherein the second plate is below and parallel to the first plate.

6. The undergarment of claim 1, wherein the first magnet and the second magnet are each sewn into the band.

7. The undergarment of claim 1, wherein the single metal plate is sewn into the tail end.

8. The undergarment of claim 1, further comprising a top portion that at least partially covers an upper torso of the user.

9. The undergarment of claim 1, further comprising a third magnet next to the first magnet at the first band end and a fourth magnet next to the second magnet at the second band end.

10. The undergarment of claim 1, where the first magnet and the second magnet have a half-circle shape and the single metal has an oval shape.

11. The undergarment of claim 1, where the first magnet and the second magnet each have a triangular shape.

12. The undergarment of claim 1, wherein the undergarment comprises lace.

13. The undergarment of claim 1, wherein the undergarment is a swimwear garment comprising waterproof fabric.

14. The undergarment of claim 1, wherein the first magnet and the second magnet are encased in a material.

15. The undergarment of claim 14, wherein the material is polyvinyl chloride plastic.

16. The undergarment of claim 1, wherein the single metal is coated in epoxy.

17. The undergarment of claim 1, wherein the band is a separate fabric from the front coverage and the back coverage, and is attached to the front coverage.

18. The undergarment of claim 17, wherein the band is lace.

* * * * *